US010052635B2

(12) United States Patent
Guerrero Palma

(10) Patent No.: US 10,052,635 B2
(45) Date of Patent: Aug. 21, 2018

(54) COMMINUTION OF GRINDING STOCK IN A VERTICAL ROLLER MILL

(71) Applicant: THYSSENKRUPP INDUSTRIAL SOLUTIONS AG, Essen (DE)

(72) Inventor: Pedro Guerrero Palma, Lippetal (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 811 days.

(21) Appl. No.: 14/415,601

(22) PCT Filed: May 23, 2013

(86) PCT No.: PCT/EP2013/060648
§ 371 (c)(1),
(2) Date: Jan. 18, 2015

(87) PCT Pub. No.: WO2014/012693
PCT Pub. Date: Jan. 23, 2014

(65) Prior Publication Data

US 2015/0151304 A1 Jun. 4, 2015

(30) Foreign Application Priority Data

Jul. 19, 2012 (DE) ..... 10 2012 106 553

(51) Int. Cl.
*B02C 15/04* (2006.01)
*B02C 15/00* (2006.01)
(Continued)

(52) U.S. Cl.
CPC ..... *B02C 15/04* (2013.01); *B02C 15/007* (2013.01); *B02C 23/02* (2013.01); *B02C 23/08* (2013.01); *B02C 25/00* (2013.01)

(58) Field of Classification Search
CPC ..... B02C 15/00; B02C 15/04; B02C 15/007; B02C 15/08; B02C 15/02
(Continued)

(56) References Cited

U.S. PATENT DOCUMENTS 1,014,383 A 1/1912 Frazee
2,144,911 A 1/1939 Cohn
(Continued)

FOREIGN PATENT DOCUMENTS

CA 1085020 A1 9/1980
DE 106953 A1 7/1974
(Continued)

OTHER PUBLICATIONS

English abstract of JPH02198648.
(Continued)

*Primary Examiner* — Faye Francis
(74) *Attorney, Agent, or Firm* — thyssenkrupp North America, Inc.

(57) ABSTRACT

In the method according to the invention for the comminution of grinding stock in a vertical roller mill, the grinding stock is fed upstream of at least one grinding roller in order to form a grinding bed and is comminuted between a grinding table and the at least one grinding roller, the grinding bed which is being formed being settable at a differing height over the width of the grinding roller by means of a feeding device.

18 Claims, 6 Drawing Sheets

(51) Int. Cl.

| | |
|---|---|
| ***B02C 23/02*** | (2006.01) |
| ***B02C 23/08*** | (2006.01) |
| ***B02C 25/00*** | (2006.01) |

(58) Field of Classification Search
USPC ..... 241/117–121
See application file for complete search history.

(56) References Cited

U.S. PATENT DOCUMENTS

| | | | | |
|---|---|---|---|---|
| 4,489,895 | A | 12/1984 | Petersen | |
| 4,869,434 | A * | 9/1989 | Folsberg | B02C 15/007 241/119 |
| 6,113,015 | A | 9/2000 | Brundiek | |
| 9,457,353 | B2 * | 10/2016 | Dunst | B02C 25/00 |

FOREIGN PATENT DOCUMENTS

| | | | |
|---|---|---|---|
| DE | 2653636 | A1 | 6/1977 |
| DE | 3311433 | A1 | 10/1983 |
| DE | 225634 | A1 | 8/1985 |
| DE | 4442099 | A | 5/1996 |
| DE | 19651103 | A1 | 6/1998 |
| DE | 19723100 | A1 | 12/1998 |
| JP | S5861839 | A | 4/1983 |
| JP | S62109743 | A | 5/1987 |
| JP | H02198648 | A | 8/1990 |
| JP | H03213157 | A | 9/1991 |
| JP | H06339639 | A | 12/1994 |
| JP | H0716482 | A | 1/1995 |
| WO | 2009007337 | A1 | 1/2009 |
| WO | 2012079605 | A1 | 6/2012 |

OTHER PUBLICATIONS

English abstract of JPH03213157.
English machine translation of JPS62109743.
English abstract of JPH0716482.
English abstract of JPH06339639.
German language International Search Report for International patent application No. PCT/EP2013/060648; dated Feb. 11, 2014.
English translation of International Search Report for International patent application No. PCT/EP2013/060648; dated Feb. 11, 2014.
English translation of abstract of DE 19651103 A1.
English translation of abstract of DE 19723100 A1.

* cited by examiner

COMMINUTION OF GRINDING STOCK IN A VERTICAL ROLLER MILL

CROSS REFERENCE TO RELATED APPLICATIONS

This application is a U.S. National Stage Entry of International Patent Application Serial Number PCT/EP2013/060648, filed May 23, 2013, which claims priority to German patent application no. DE 102012106553.5, filed Jul. 19, 2012.

FIELD

The invention relates to a method for the comminution of grinding stock in a vertical roller mill and to a vertical roller mill, the grinding stock being fed upstream of at least one grinding roller in order to form a grinding bed and being comminuted between a grinding table and at least one grinding roller.

BACKGROUND

In vertical roller mills, material distribution on the grinding table depends on many factors (grinding stock, rotational speed, grinding bed height, feed point, etc.) which sometimes even influence one another.

DD 106 953 A1 and DE 44 43 099 A1 disclose methods for the comminution of grinding stock in a vertical roller mill, the grinding stock being fed to at least one grinding roller in order to form a grinding bed and being comminuted between a grinding table and the at least one grinding roller. On account of the geometry of the grinding roller, a grinding bed of differing height is formed over the width of the grinding roller.

DD 225 634 A1 discloses a roller mill with a feed device, by means of which a grinding bed formed as uniformly as possible can be achieved.

DE 196 51 103 A1 addresses the problem of air included in the grinding bed and, in order to deaerate the grinding stock located on the grinding table, proposes to feed the grinding stock to the grinding table in layers, the fine stock fraction forming essentially a lower first grinding stock layer and the coarse stock fraction forming essentially a second grinding stock layer, lying above it, in the grinding bed. According to a first variant, the grinding stock is fed centrally, whereas, in a second exemplary embodiment, separate feeding upstream of each grinding roller takes place.

To improve the grinding stock drawing-in conditions of the grinding roller and to ensure more efficient grinding, DE 197 23 100 A1 proposes stock guide elements or stock guide blades which are held on common carrying arms arranged above the grinding table and in this case can be set in respect of their elevation and/or in respect of a stock guide direction.

Nevertheless, in spite of these known measures, during grinding operation vibrations repeatedly occur and are then kept low by means of a high grinding bed or an injection of water at the expense of grinding efficiency.

SUMMARY

The object on which the invention is based, therefore, is to improve the method for the comminution of grinding stock in a vertical roller mill and the vertical roller mill required for this purpose, to the effect that vibrations are further reduced and grinding efficiency is increased.

BRIEF DESCRIPTION OF THE DRAWINGS

The present disclosure is described in detail below with reference to the attached drawing figures, wherein.

DETAILED DESCRIPTION

Figure 1:
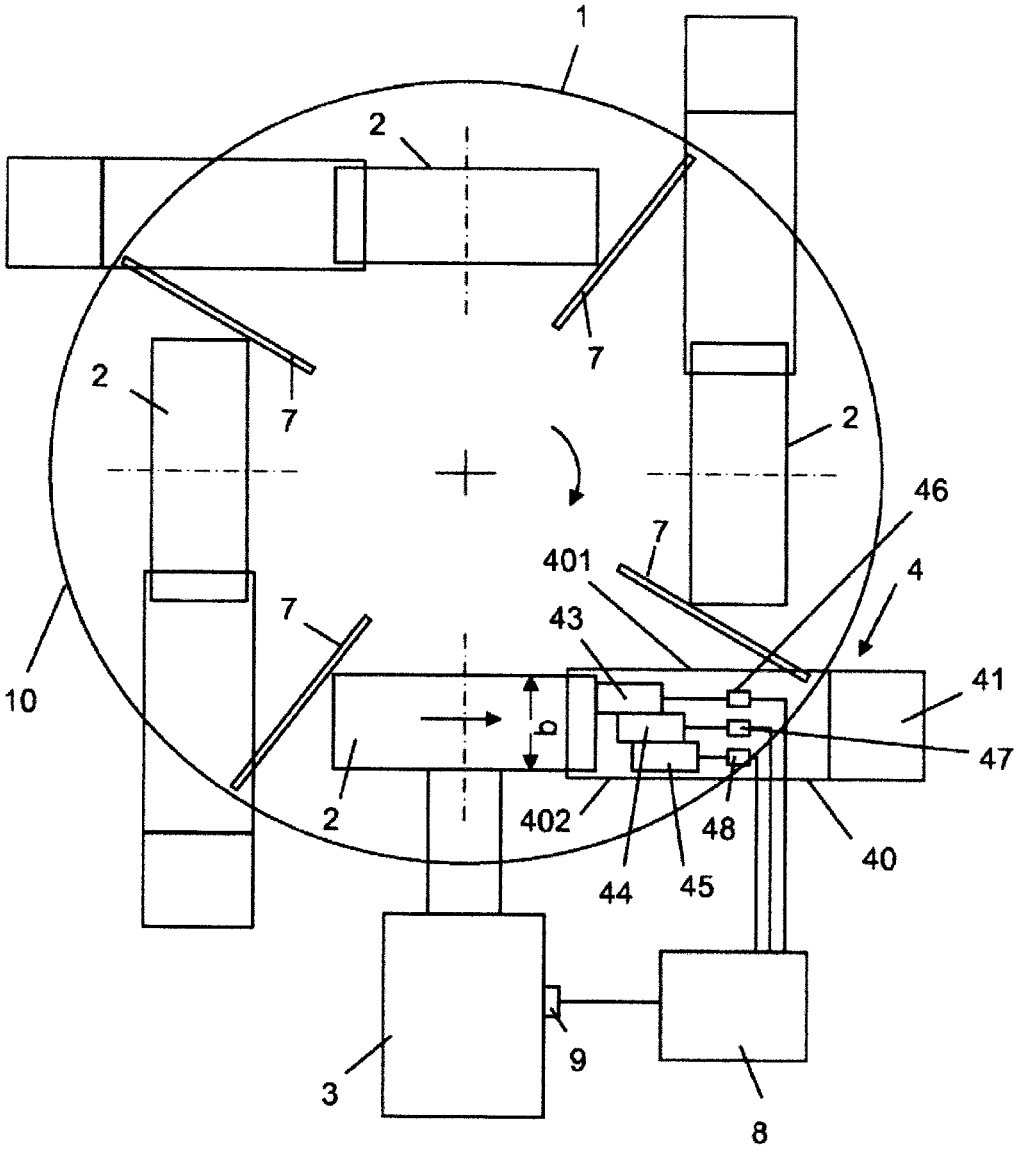
FIG. 1 is a schematic top view of an embodiment of a vertical roller mill of the present disclosure.

In the method according to the invention for the comminution of grinding stock in a vertical roller mill, the grinding stock is fed upstream of at least one grinding roller in order to form a grinding bed and is comminuted between a grinding table and the at least one grinding roller, the grinding bed which is being formed being set at a differing height over the width of the grinding roller by means of a feeding device.

The vertical roller mill according to the invention for the comminution of grinding stock has a grinding table and at least one grinding roller cooperating with the grinding table and also a feeding device in order to feed the grinding stock to the at least one grinding roller, a grinding bed being formed at the same time. The feeding device is designed for the selective setting of a differing height, over the width of the grinding roller, of the grinding bed which is being formed.

In the conventional operation of a vertical roller mill, an attempt is made to deliver the grinding stock to the grinding roller at as uniform a height as possible. With the aid of a stock guide device, such as is known, for example, from DE 197 23 100 A1, this can take place relatively reliably even when the vertical roller mill is operated in different ways. By means of the feeding device according to the invention, it is possible to set not only a uniform height of the grinding bed over the width of the grinding roller, but also a grinding bed which, for example, rises or falls in its height towards the grinding table rim. A grinding bed height rising towards the grinding table rim is expedient particularly when the vertical roller mill is to be operated at maximum throughput. Since the circumferential speed of the grinding table rises in the direction of the grinding table rim, the comminuting action is also greatest there. If, by contrast, the grinding roller is already partially worn, an increase in efficiency can thus be achieved when the grinding bed falls in height towards the grinding table rim and the radially inner region is thus first to be used. If, however, the vertical mill is to be operated with minimum energy consumption, a grinding bed with a uniform height over the width of the grinding roller will be set. The grinding bed can thus be optimized in its height in a manner selected at the desired mode of operation in each case, with the result that, in the respective mode of operation, vibrations are reduced and grinding efficiency is increased.

Further refinements of the invention are the subject-matter of the subclaims.

The feeding device is preferably designed such that the height of the grinding bed can be set such that it can be varied continuously or in steps in the direction towards the grinding table rim. Furthermore, there may be provision whereby the width of the grinding bed is limited by the feeding device and is adapted to the width of the grinding roller. Moreover, the grinding stock may selectively be fed in the middle of the grinding table and be guided to the feeding device via guide devices or it is fed directly to a feeding device assigned to each grinding roller.

According a further refinement of the invention, the height of the grinding bed is continuously readjusted, during comminution, over the width of the grinding roller as a function of at least one operating parameter, for example quiet running or power consumption. For this purpose, a suitable control and regulating device is provided, which is connected to at least one measuring device for detecting the operating parameter and to the feeding device.

The feeding device is preferably formed by one or two, most preferably three or more slides which are arranged next to one another over the width of the grinding rollers and can be set identically or differently in the distance from the grinding table.

According to an exemplary embodiment of the invention, the feeding device has lateral boundaries for the grinding bed, the distance between which corresponds approximately to the width of the grinding roller. In this case, the lateral boundary pointing towards the middle of the grinding table may have a grinding stock feeding orifice.

Furthermore, downstream of the grinding roller, a stripping device for stripping off the ground grinding stock from the grinding table is provided. What is considered particularly as a vertical roller mill is an air-swept mill or an edge mill.

Further advantages and refinements of the invention are explained in more detail below by reference to the enclosed drawing figures.

Figure 2:
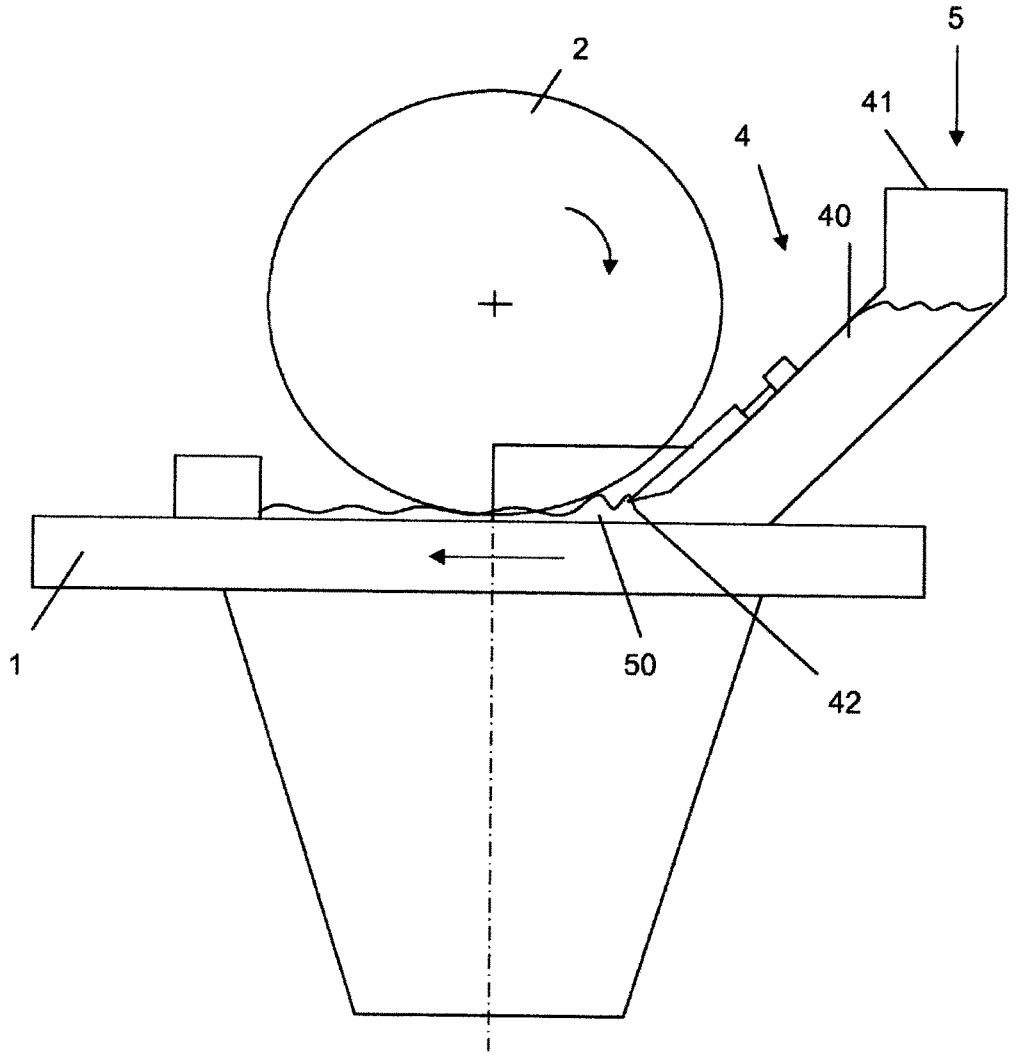
FIG. 2 is a schematic side view of the vertical roller mill of FIG. 1.

The vertical roller mill illustrated in FIGS. 1 and 2 has a grinding table 1 and a plurality of grinding rollers 2. In this case, selectively, the grinding table and/or the grinding rollers can be driven. In the exemplary embodiment illustrated, a drive 3 is illustrated, for example, for one of the grinding rollers 2. Normally, however, at least two grinding rollers, preferably all the grinding rollers, are driven, in so far as the vertical roller mill does not only have a grinding table drive.

In the exemplary embodiment illustrated, each grinding roller 2 is assigned a feeding device 4, with the aid of which grinding stock 5 is fed to the grinding roller 2, a grinding bed 50 being formed at the same time. The said feeding device is composed essentially of a shaft 40 with a material feeding orifice 41 and with lateral boundaries 401, 402 which limit the width of the grinding bed 50 and the distance between which corresponds essentially to the width b of the grinding roller 2. Furthermore, three slides 43, 44, 45 are provided, which are arranged next to one another over the width of the grinding rollers and can be set at an identical or different distance from the grinding table 1 and thereby define the outlet orifice 42.

Figure 6:
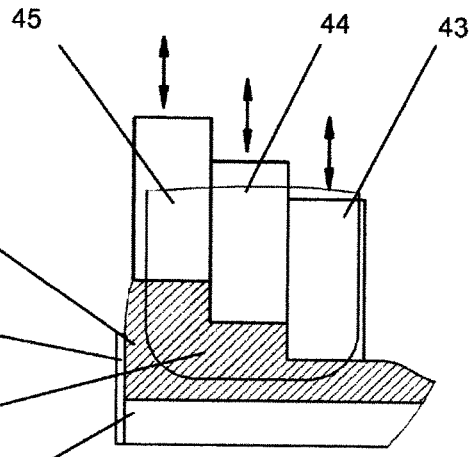
FIG. 6 is a schematic diagram of the feeding device of FIG. 5, in which the three slides are set so as to generate a grinding bed that increases in height towards the grinding rim.

The position of the slides 43, 44, 45 according to FIG. 1 is illustrated once again in a front view in FIG. 6. The slides 43, 44, 45 can be individually set singularly or as a group by means of suitable drives 46, 47, 48, for example by means of hydraulic cylinders. The height of the grinding bed 50 which is being formed according to FIG. 6 is set by the slides such that it rises in steps in the direction towards the grinding table rim 10. Such a position of the slides is useful, above all, when the vertical roller mill is to be operated at maximum throughput.

Figure 7:
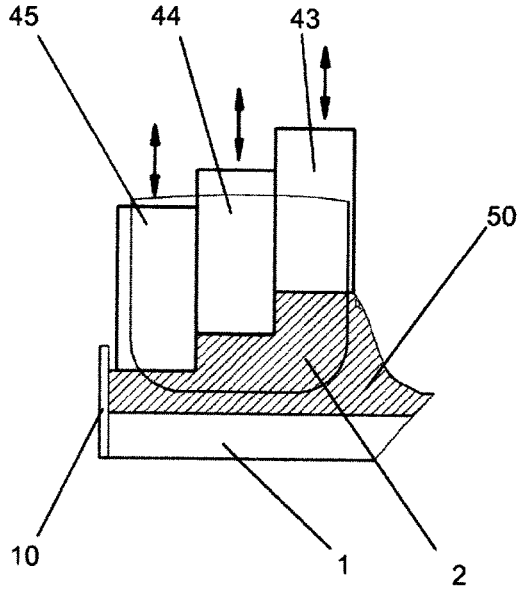
FIG. 7 is a schematic diagram of the feeding device of FIG. 5, in which the three slides are set so as to generate a grinding bed that decreases in height towards the grinding rim.

FIG. 7 shows a position of the slides 43-45 in which the height of the grinding bed 50 rises inwards. Such a position is expedient when the inner regions of the running surface of the grinding roller 2 are already worn to a relatively great extent.

Figure 5:
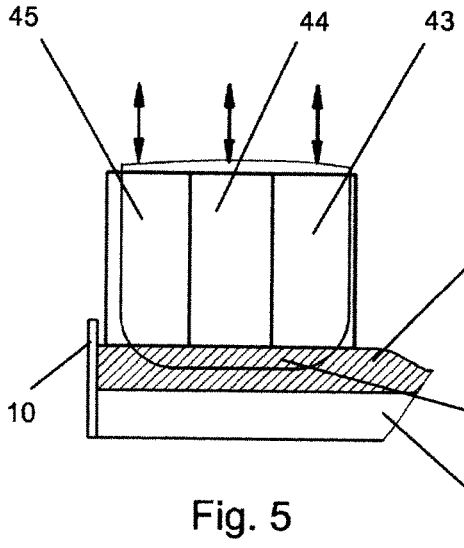
FIG. 5 is a schematic side view of an embodiment of a feeding device of the present disclosure, having three slides set so as to generate a grinding bed of uniform height.

In FIG. 5, the slides 43, 44, 45 are set at an identical distance from the grinding table. A grinding bed of uniform height is thus also set, thereby making it possible for the vertical roller mill to have a mode of operation which is beneficial in energy terms. In addition to the illustrations in FIGS. 5 to 7, the slides may also be set such that the height of the grinding bed falls or rises inwards and outwards from the middle. Such a position of the slides is useful, above all, when the axial load and therefore axial vibrations of the grinding roller are to be reduced.

Figure 8:
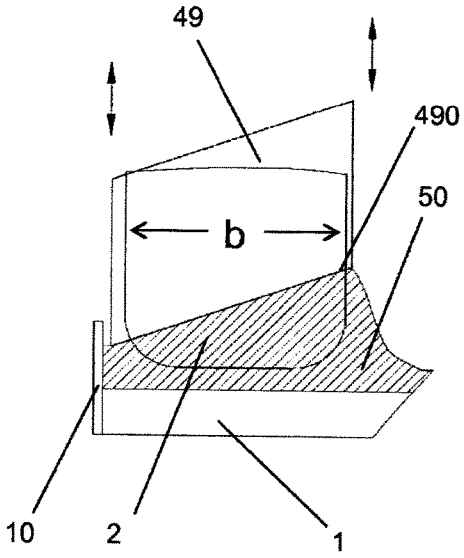
FIG. 8 is a schematic side view of an alternate embodiment of a feeding device of the present disclosure, having a single slide configured to generate a grinding bed that reduces in height towards the grinding rim.

Instead of three single slides arranged next to one another, two or more than three slides may, of course, also be provided. Moreover, FIG. 8 shows an exemplary embodiment with a single slide 49 which extends over the entire width b of the grinding roller and the lower edge 490 of which can be oriented to be straight or oblique to the grinding table 1 according to the grinding bed 50 to be formed. The height can thereby be increased or reduced continuously over the width of the grinding roller.

Figure 9:
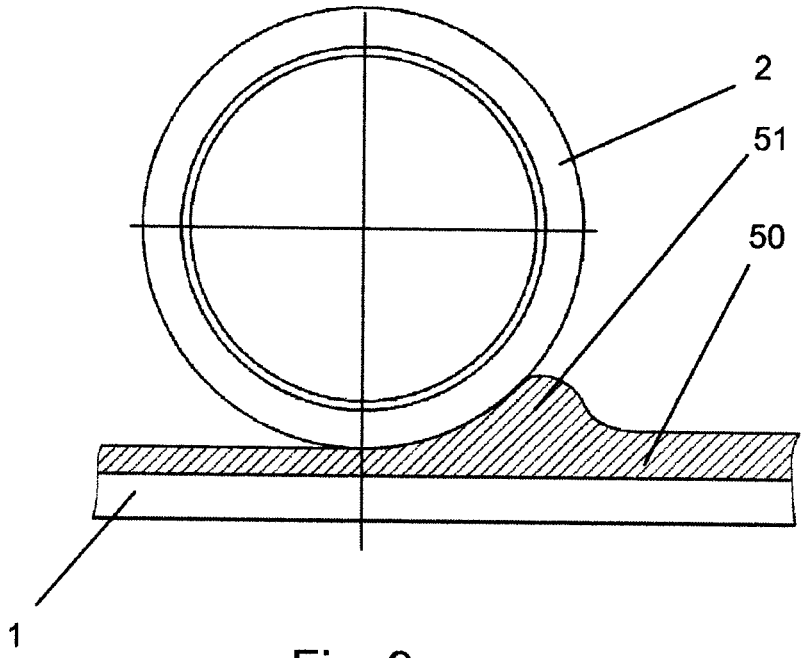
FIG. 9 is a schematic side view of a grinding roller having a material wave built up upstream of the grinding roller.
Figure 10:
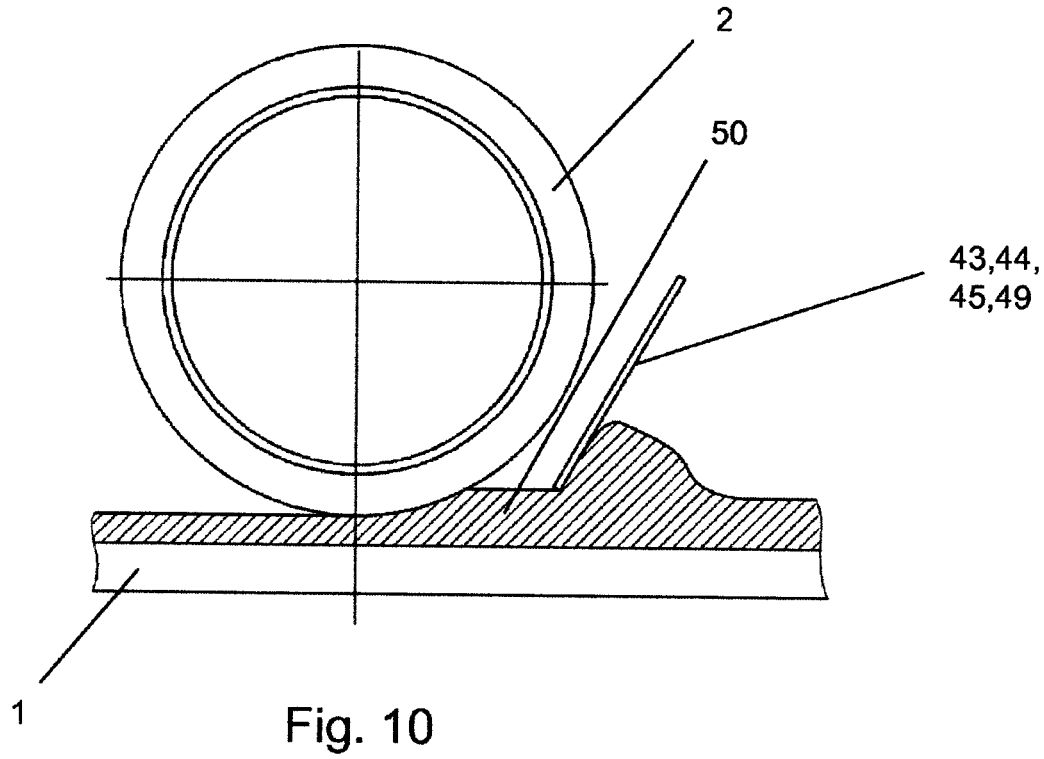
FIG. 10 is a schematic side view of a grinding bed set to an optimal height by a feeding device.

The slides 43, 44, 45 and 49, however, not only have the task of setting the height of the grinding bed over the width of the grinding roller, but also ensure that only sufficient grinding stock is fed to the grinding roller 2 so that there is no material wave 51 formed upstream of the grinding roller 2, as illustrated in FIG. 9, but instead a situation occurs, as is illustrated in FIG. 10. The formation of a material wave 51 would otherwise lead to considerable vibrations and to an impairment in quiet running.

Downstream of each grinding roller 2, a stripping device 7 for discharging the ground grinding stock 5 from the grinding table 1 is provided.

Figure 3:
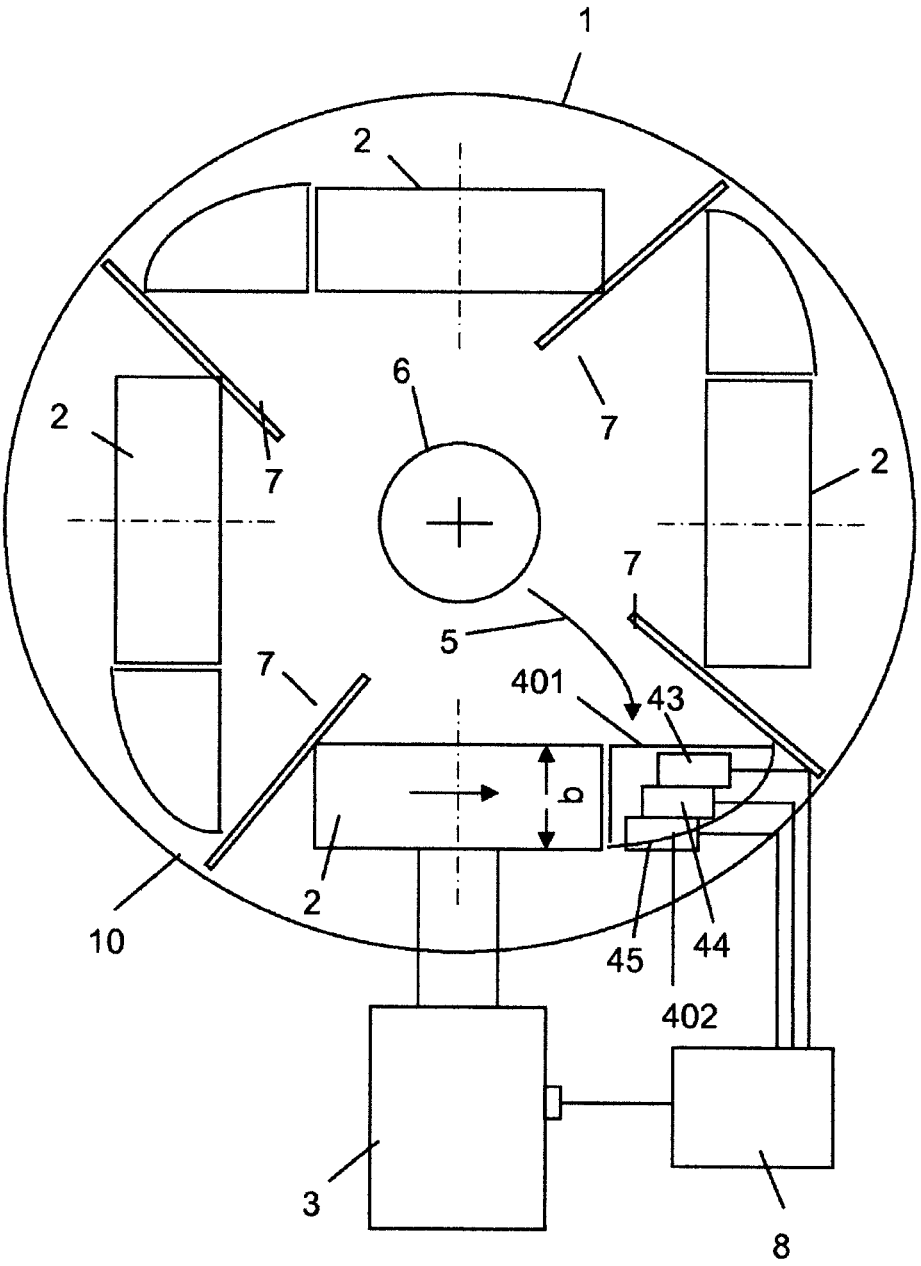
FIG. 3 is a schematic top view of an alternate embodiment of a vertical roller mill of the present disclosure.
Figure 4:
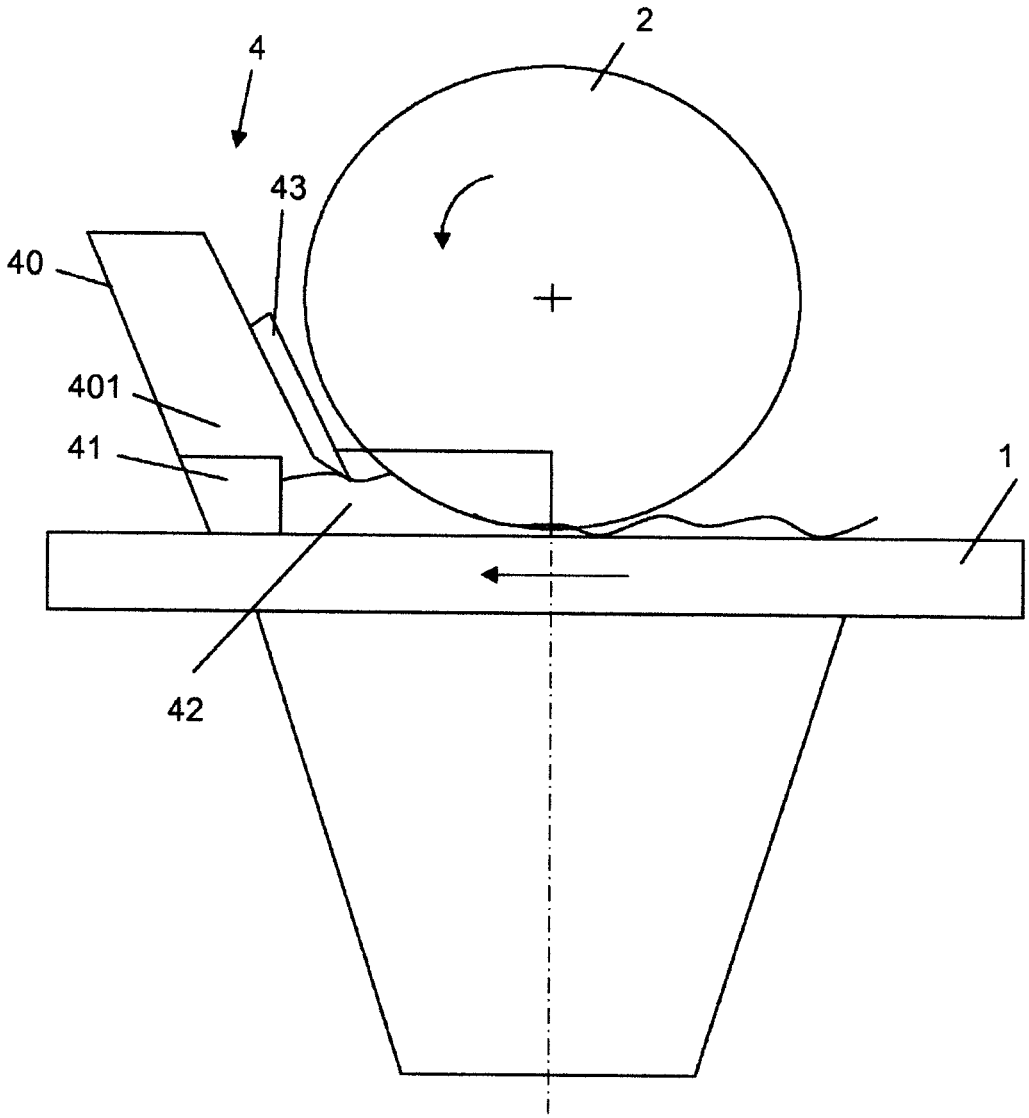
FIG. 4 is a schematic side view of the vertical roller mill of FIG. 3.

Within the scope of the invention, however, it is also conceivable that the grinding stock 5 is fed to the grinding table 1 via a central feed device 6, as illustrated in the exemplary embodiment according to FIGS. 3 and 4. Here, too, each grinding roller 2 is assigned a feeding device 4 which again has a plurality of slides 43, 44, 45 arranged next to one another or a single slide 49, with the aid of which the height of the grinding bed 50 can be set over the width of the grinding roller. Here, too, the feeding device has a kind of shaft 40, the material introduction orifice 41 of which is not, however, at the upper end of the shaft, but instead is arranged in the lateral boundary 401 pointing towards the middle of the grinding table. The grinding stock 5 fed in the middle of the grinding table 1 via the feed device 6 arrives as a result of the centrifugal force action of the rotating grinding table 1 at the material introduction orifices 41 and passes via these into the feeding device 4.

The grinding stock 5 comminuted by the grinding rollers 2 is, in turn, stripped off downstream of the grinding roller 2 via the grinding table rim 10 by means of stripping devices 7. This stripping device is expediently arranged such that it acts on its other side as a guide device for guiding the grinding stock 5 to the introduction orifices 41 of the feeding devices 4.

The vertical roller mill may be designed, for example, as an air-swept mill or as an edge mill. Where an edge mill is concerned, the comminuted grinding stock 5 discharted via the grinding table rim 10 falls downwards and is suitably drawn off there. In the case of an air-swept mill, an air stream flows from below upwards past the grinding table rim 10 and at the same time picks up the comminuted grinding stock which, together with the air stream, passes into a separator mostly arranged above the grinding table. When the air-swept mill is operated with a hot air stream, in addition to comminution, drying of the grinding stock can also take place at the same time. Since an edge mill and an air-swept mill are sufficiently known from the prior art, further details are therefore not dealt with.

Via a suitable control and regulating device 8, the drives 46-48 of the slides 43-45 can be activated even during the comminuting operation. The mode of operation of the vertical roller mill can thus be influenced in a selective manner as a function of at least one operating parameter by a variation in the height of the grinding bed over the width of the grinding roller 2. For this purpose, the control and regulating device 8 is connected to a suitable measuring device 9. This measurement device can, for example, detect at least one of the following operating parameters: quiet running, power consumption of the drives of grinding rollers and/or grinding table, etc.

With the aid of the slides, the stability of the grinding bed 50 can be markedly increased, in that the grinding bed height over the width of the grinding roller is adapted to the mode of operation, the grinding stock and the state of wear of the grinding roller. A further increase in grinding bed stability occurs owing to the fact that a material wave 51, as shown in FIG. 9, is avoided. Moreover, the grinding stock can be fed by the slides in a highly selective manner and so as to be distributed optimally over the width of the grinding roller. This has a positive effect upon quiet running and grinding efficiency and, moreover, stabilizes the material bed.

The invention claimed is:

1. A method for comminution of grinding stock in a vertical roller mill, the method comprising:

providing a feeding device, feeding the grinding stock upstream of at least one grinding roller to form a grinding bed;

varying a height of the grinding bed with the feeding device over a width of the at least one grinding roller;

comminuting the grinding stock in the grinding bed between a grinding table and the at least one grinding roller.

2. The method of claim 1, wherein the height of the grinding bed is set such that the height varies at least one of continuously or in steps in a direction towards a rim of the grinding table.

3. The method of claim 1, further comprising discharging the grinding stock that has been comminuted from the grinding table downstream of the at least one grinding roller.

4. The method of claim 1, wherein a width of the grinding bed is limited by the feeding device and is adapted to the width of the at least one grinding roller.

5. The method of claim 1, further comprising:

feeding the grinding stock in a middle of the grinding table; and guiding the grinding stock to the feeding device via guide devices.

6. The method of claim 1, further comprising continuously readjusting the height of the grinding bed during said comminuting step, over the width of the at least one grinding roller as a function of at least one operating parameter.

7. The method of claim 1 comprising:

providing the vertical roller mill with the grinding table, and providing the at least one grinding roller that cooperates with the grinding table.

8. The method of claim 7 comprising providing the feeding device, which has at least two slides that are disposed next to one another over the width of the at least one grinding roller.

9. The method of claim 1 comprising providing the feeding device, which has at least two slides that are disposed next to one another over the width of the at least one grinding roller, wherein the varying of the height of the grinding bed over the width of the at least one grinding roller comprises setting a first of the at least two slides at a distance that is farther from the grinding table than a distance between a second of the at least two slides and the grinding table.

10. A vertical roller mill for comminution of grinding stock, the vertical roller mill comprising:

a grinding table;

at least one grinding roller cooperating with the grinding table; and a feeding device to feed the grinding stock to the at least one grinding roller, wherein the feeding device is selectively movable between different heights over a width of the at least one grinding roller for forming a grinding bed with a height that varies over the width of the at least one grinding roller.

11. The vertical roller mill of claim 10, wherein the feeding device has at least two slides that are arranged next to one another over the width of the at least one grinding roller and can be set identically or differently in terms of distance from the grinding table.

12. The vertical roller mill of claim 10, wherein the feeding device is a feeding chute.

13. The vertical roller mill of claim 10, wherein the feeding device has lateral boundaries for the grinding bed, a distance between which corresponds to the width of the at least one grinding roller.

14. The vertical roller mill of claim 13, wherein one of the lateral boundaries pointing towards a middle of the grinding table has a grinding stock feeding orifice.

15. The vertical roller mill of claim 10, wherein a stripping device for discharging the grinding stock that has been comminuted from the grinding table is provided downstream of the grinding roller.

16. The vertical roller mill of claim 10, wherein the vertical roller grinding mill is an air-swept mill or an edge mill.

17. The vertical roller mill of claim 10, further comprising:

at least one measuring device for detecting an operating parameter of the vertical roller mill; and a control and regulating device, wherein said control and regulating device is connected to said at least one measuring device and to said feeding device for setting the height of the grinding bed as a function of the operating parameter.

18. The vertical roller mill of claim 10 wherein the feeding device comprises at least two slides disposed next to one another over the width of the at least one grinding roller, wherein a first of the at least two slides is positionable at a distance that is farther from the grinding table than a distance between a second of the at least two slides and the grinding table.

* * * * *